United States Patent [19]

Ghosh et al.

[11] Patent Number: 4,777,457

[45] Date of Patent: Oct. 11, 1988

[54] DIRECTIONAL COUPLER FOR SEPARATION OF SIGNALS IN TWO FREQUENCY BANDS WHILE PRESERVING THEIR POLARIZATION CHARACTERISTICS

[75] Inventors: Subir Ghosh; Aluízio Prata, Junior, both of São Paulo, Brazil

[73] Assignee: Telecomunicacoes Brasileiras S/A - Telebras, Brazil

[21] Appl. No.: 77,986

[22] Filed: Jul. 27, 1987

Related U.S. Application Data

[63] Continuation of Ser. No. 760,363 filed as PCT BR84/00005 on Oct. 24, 1984, published as WO85/02065 on May 9, 1985, abandoned.

[30] Foreign Application Priority Data

Oct. 25, 1983 [BR] Brazil ..... 8305993[U]

[51] Int. Cl.[4] ..... H01P 1/213; H01P 5/18

[52] U.S. Cl. ..... 333/110; 333/113; 333/135

[58] Field of Search ..... 333/110, 113, 126, 129, 333/134, 135, 212

[56] References Cited

U.S. PATENT DOCUMENTS

| | | | |
|---|---|---|---|
| 2,866,595 | 12/1958 | Marie | 333/110 X |
| 2,912,695 | 11/1959 | Cutler | 343/781 |
| 3,086,203 | 3/1961 | Hutchison | 343/786 X |
| 3,265,993 | 2/1964 | Davidson et al. | 333/1 |
| 3,413,642 | 11/1968 | Cook | 343/781 |
| 3,618,106 | 11/1971 | Bryant | 343/772 |
| 3,838,362 | 9/1974 | Kurtz | 333/135 |
| 3,922,621 | 11/1975 | Gruner | 333/21 R X |
| 3,964,070 | 6/1976 | Drabowitch | 343/786 |
| 4,048,592 | 9/1977 | Drabowitch | 333/137 |
| 4,162,463 | 7/1979 | DiTullio et al. | 333/117 |
| 4,367,446 | 1/1983 | Hall | 333/135 |
| 4,439,748 | 3/1984 | Dragone | 343/786 X |
| 4,520,329 | 5/1985 | D'Oro et al. | 333/135 |

FOREIGN PATENT DOCUMENTS

| | | | |
|---|---|---|---|
| 2455803 | 11/1980 | France . | |
| 2525358 | 10/1976 | Fed. Rep. of Germany . | |
| 56-2702 | 1/1981 | Japan . | |
| 887574 | 1/1962 | United Kingdom | 333/212 |
| 1498905 | 1/1978 | United Kingdom . | |
| 1578734 | 11/1980 | United Kingdom | 333/113 |

OTHER PUBLICATIONS

13th European Microwave Conference, Sep. 5-8, 1983, A. D. Oliver et al., "Dual Depth Corrugated Horn Design", pp. 879-884.

(List continued on next page.)

*Primary Examiner*—Eugene R. LaRoche
*Assistant Examiner*—Benny Lee
*Attorney, Agent, or Firm*—Finnegan, Henderson, Farabow, Garrett & Dunner

[57] ABSTRACT

A directional coupler is provided which has an appropriately dimensioned principle waveguide with a frequency dependent reactive boundary interior surface such that the principle waveguide is suitable to simultaneously: (i) support, without depolarization, effective propagation of first signals in a high frequency band at a HE11 mode with greater concentration of energy near the axis of the principle waveguide than near the interior surface and no effective propagation of first signals at any unwanted mode, and (ii) support, without depolarization, effective propagation of second signals in a lower frequency band at a EH11 mode having a greater concentration of energy near the interior surface of the principle waveguide than near the axis and no effective propagation of second signals at any unwanted mode. Four identical secondary waveguides are placed symmetrically at equal radial intervals about the outside perimeter of the principle waveguide with the longitudinal axis of each of the secondary waveguides running parallel to the longitudinal axis of the principle waveguide. A plurality of coupling units are disposed at longitudinal intervals along the principle waveguide with each coupling unit comprising four aperture-like structures interconnecting a respective one of the secondary waveguides and the principle waveguide for exchanging energy in the first signals between the secondary waveguides and the principle waveguide. This structure provides a directional coupler for separation of signals in the first and second frequency bands while preserving their polarization characteristics.

15 Claims, 5 Drawing Sheets

OTHER PUBLICATIONS

AP-S International Symposium 1980, IEEE. vol. 1, S. Ghosh, "A Corrugated Wave Guide Feed for Discrete Multi-Bank Applications having Dual Dept Corrugations"; pp. 217-222.

Electronics Letters, V. 18, No. 20, Sep. 30, 1982, S. Ghosh, "Hybrid-Mode Feed for Multiband Applications Having a Dual Depth Corrugation Boundary", pp. 860-862.

A Dual-Band Corrugated Feed Horn, Carpenter, Ap-S International Symposium, 1980, vol. 1, IEEE (New York, U.S.), pp. 213-216.

A 20 GHz and 30 GHz Bands Transmit-Receive Filter Using Square Waveguide, Shindo; 12334 Abstracts of IEEE Transactors, vol. 50, No. 10, (1975.10).

Eine Symstemweiche zur Trennung der 4-und 6-GHz-Richfunkbander nach Frequenz under Polarisation, Schnetzler, Nachrichtentechnische Zeitschrift N.T.Z., vol. 22 pp. 144-145.

DIRECTIONAL COUPLER FOR SEPARATION OF SIGNALS IN TWO FREQUENCY BANDS WHILE PRESERVING THEIR POLARIZATION CHARACTERISTICS

This application is a continuation of application Ser. No. 760,363, filed as PCT BR84/00005 on Oct. 24, 1984, published as W085/02065 on May 9, 1985, now abandoned.

BACKGROUND OF THE INVENTION

I. Field of the Invention

This invention relates to a directional coupler configured in a corrugated waveguide for separating signals in two bands of frequencies while maintaining their polarization characteristics of any arbitrary nature unaltered in each band. This invention can be also considered to be a diplexing device which permits the polarization characteristics of any arbitrary nature to be translated without any change at each frequency band.

II. Background Information

As is well known, satellite communication systems operate through the use of two distinct and well defined frequency bands where the higher frequency band (uplink) carries signals from the earth stations to the satellite while signals are sent from the satellite towards the earth stations in the lower frequency band (downlink). Moreover, to achieve better utilization of the available frequency bands, the frequencies are, often, reused by means of orthogonal polarizations.

For such a frequency reuse mode of operation, a diplexing system employs a diplexer which fulfills the requirement for separation of signals in two frequency bands without loss of polarization characteristics by band selective transduction of orthogonally polarized modes. In order to preserve the polarization characteristics, the diplexing system ought to present, at the same time, a low return loss characteristics in both bands. Furthermore, often such a system is rated to handle in a transmit band a high level of microwave power, typically, going up to 10 KW in each orthogonal polarization of the reused frequency.

With the recent introduction of greater available bandwidth, which extends from 3.4 to 4.8 GHz (excluding the segment of 4.2 to 4.5 GHz) for the downlink and from 5.8 to 7.075 GHz for the uplink and with specifications on the electrical performance continuing to allow reuse of frequency, all the existing designs of the frequency reuse diplexers fall well short of operating satisfactorily in these extended bands. Among the presently known frequency reuse diplexers, the ones that use quasi-optic filters are potentially limited in terms of available bandwidth and degradation of orthogonality of polarization. The ones in waveguides without corrugations on the walls do not accommodate the above stated extended bands without either generation of unwanted higher order modes or creation of high return loss. Any of the above two phenomena contributes towards deterioration of the polarization isolation and hence precludes such type of structures. Finally, the ones which are so far known to have used corrugated structures, have an abrupt transition into a co-axially arranged waveguide configuration followed by a branching waveguide network to separate the receive band while maintaining its polarization properties. Apart from having inherently high insertion loss in the downlink, this type of structure in their presently known configuration are susceptible to overmoding and poor return loss characteristics for extended bands of operation.

SUMMARY OF THE INVENTION

The objective of this invention has, therefore, been to develop a diplexer for satellite communication earth station antennas that operates in the above mentioned extended bands while preserving the polarization characteristics of the signals in each of the two bands. The invented diplexer, in conformity with the requirements for earth station application, ascertains low insertion loss in the downlink while being capable of handling high level of microwave power in the uplink.

The subject of the present patent application is, therefore, an Orthogonal Mode Transduced Diplexer, hereafter referred to as OMTD. It employs a principal central waveguide to allow unattenuated propagation of microwave power in certain desired modes while preventing propagation in other unwanted modes, with such being held true for signals in both the uplink and downlink. This waveguide, actually, has a frequency dependent reactance boundary wall by means of which, together with the appropriate dimensions of the waveguide, permits the propagation of HE11 hybrid mode (characterized by greater concentration of energy near the waveguide axis) in the uplink, and of EH11 hybrid mode (characterized by greater concentration of energy near the boundary wall) in the downlink. Furthermore, this principal waveguide has, disposed on it from outside symmetrically about its perimeter, four mutually identical secondary waveguides running axially parallel to itself such that a pair formed by two secondary waveguides located in diametrically opposite positions, is orthogonal to the similarly formed second pair. There exists a means of communicating energy between the principal and the secondary waveguides through units of coupling mechanisms which coincide with the secondary waveguides in their symmetric display about the axis of the principal waveguide. The secondary waveguides are dimensioned such that when a plurality of appropriately spaced coupling units are employed along the axial length of the waveguides, it is possible to achieve efficient and directive exchange of energy between the principal and secondary waveguides only in the uplink while preventing any exchange in the downlink.

By virtue of the different propagation characteristics presented in the uplink and downlink by the principal waveguide with a reactance boundary wall, a selective matching of the propagation constants in principal and secondary waveguides is achieved only for the uplink while maintaining a wide difference in propagation constants in the downlink. As a result, practically complete transference of energy between the principal and the secondary waveguides with good directional behaviour in the entire uplink is rendered possible by means of a plurality of accurately spaced coupling units, while in the downlink the signals are propagated across the principal waveguide of the OMTD unaffected.

In its operation, therefore, the above discussed OMTD utilizes, first, the periodic broad band propagation behaviour of a waveguide with reactance boundary wall and, secondly, the broad band coupling characteristics of a multihole directional coupler arrangement in such a manner that the combined result is an efficient separation of dual orthogonally polarized transmit and receive signals within a compact layout. And in its electrical characteristics, as a potential advantage, the OMTD has a large available bandwidth of operation over which it exhibits good isolation between uplink and downlink signals, low return loss and excellent isolation of orthogonal polarizations in both bands of operation, extremely low insertion loss in the downlink and a capacity to handle high level of microwave power in the uplink.

BRIEF DESCRIPTION OF THE DRAWINGS

The invention can be yet better comprehended from the detailed description that will now follow which makes reference to the figures that are first described briefly.

DESCRIPTION OF THE PREFERRED EMBODIMENT

Figure 1:
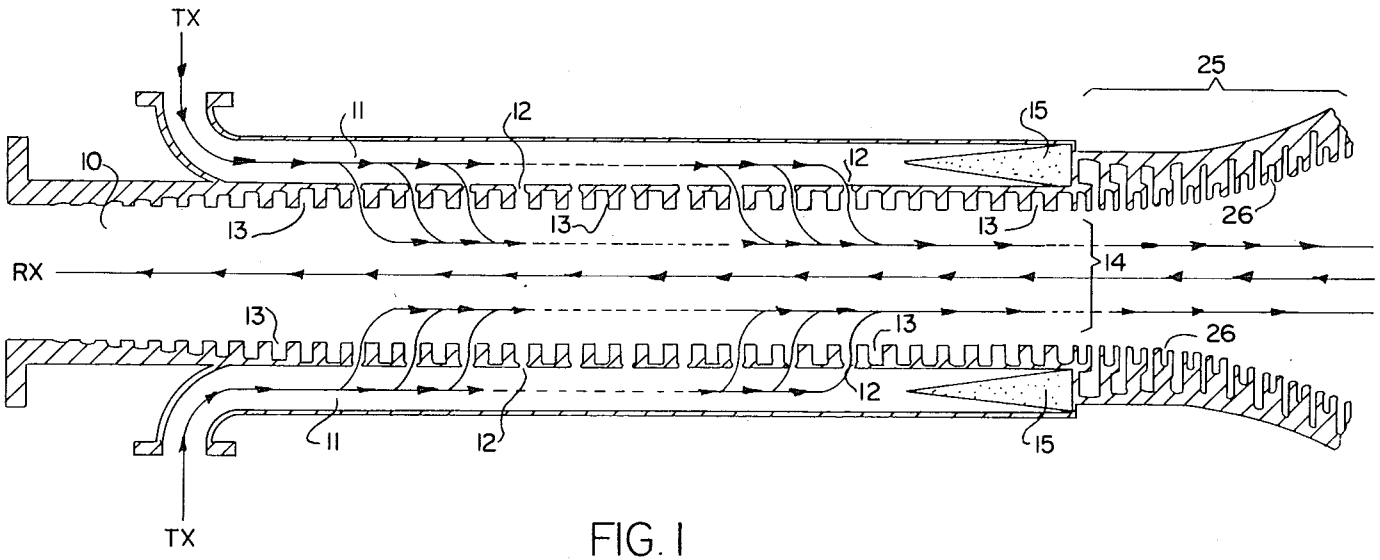
FIG. 1 illustrates through a simplified cross-sectional view taken along the length of the device, the essential configuration of an OMTD constructed in accordance with the principles of the present invention.
Figure 2:
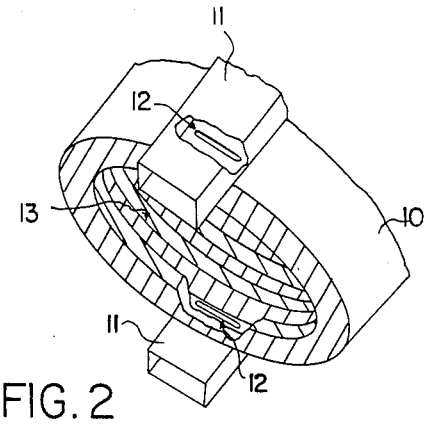
FIG. 2 illustrates a perspective view, partly in cutaway, of the coupling units for energy transfer in the uplink between the principal and secondary waveguides; however, with only two of the four secondary waveguides actually disposed being shown.

Referring for the moment to FIGS. 1 and 2, the described configuration in these figures is one of the implemented models of the OMTD which is constructed in accordance with the principles of the present invention. In this case, the principal circular waveguide (10) comprises a plurality of slots (13) constructed by placement of transversely aligned washer like irises upon the inner boundary wall of the waveguide referred above to create the corrugation boundary. The spacing between the irises is related to result in the propagating hybrid modes in the principal waveguide at the uplink having a phase change of no more than 90° between two successive corrugation slots. This principal waveguide (10) has, directly on the circumference of its outer wall, four identical secondary waveguides (11) of rectangular cross-section running parallel to the axis of the principal waveguide. These secondary rectangular waveguides (11) with their broad wall touching the circumferencial wall of the principal waveguide, are disposed such that a symmetric configuration is constructed (about the axis of the principal waveguide) consisting of two pairs of mutually orthogonally placed secondary waveguides; where each pair is defined by two secondary waveguides (11) located in diametrically opposite positions. Through the common wall between the principal and secondary waveguides, which is narrow in thickness, a plurality of coupling units (12) are periodically spaced along the axes of the waveguides. A coupling unit, as referred above, comprises an aperture, although it also could be an arrangement of apertures of a suitable geometry to allow optimization of coupling response across the band of interest. The coupling units dimensionally, however, do not exceed in the transversal direction beyond the limits of the common wall and along the axes of the waveguides are limited by the corrugation slot width. The periodicity of the coupling units and the corrugations in the principal waveguide are in such a match that these coupling units (12) always find themselves centrally located across the width of a corrugation slot (13) in the principal waveguide. Furthermore, the coupling units (12) appearing in any particular transverse plane, obviously there are four per cross-section, are identical in configuration and are also subjected to coinciding symmetry constraints on their disposition around the principal waveguide (10) with that of the secondary waveguides (11).

The above described OMTD, developed for application in frequency reuse satellite communication earth station systems, launches signals in the uplink band through the four secondary waveguide ports (Tx). A practically complete coupling of the uplink signals into the principal waveguide (10) is achieved through the multiple coupling arrangement (12) that has been previously described. The corrugations in the principal waveguide (10) are so configured that a high reactance capacitive boundary condition is simulated in the uplink and, therefore, the signals coupled from the secondary waveguides excite HE11 hybrid mode in the principal waveguide having greater concentration of energy near the axis of the principal waveguide. Due to the directional coupling behaviour associated with a multihole coupler arrangement, the uplink signals carried by the HE11 hybrid mode propagate unidirectionally towards the common port (14). The state of polarization of the so coupled HE11 hybrid mode in the principal waveguide is dependent on the amplitude and phase relationship of the uplink signals that are launched into the four secondary waveguide ports (Tx). It is worthwhile to emphasize here that both, the completeness of energy transfer and a well defined directivity of propagation in the desired sense as have been referred above with regard to the coupling between principal and secondary waveguide, are important characteristics which must be well fullfilled in the OMTD for the uplink. These characteristics in a configuration, consisting of a multi-hole directional coupler arrangement, are essentially determined by the simultaneous fullfillment of two conditions, namely, a close agreement of phase propagation constant between the modes in principal and secondary waveguides across the entire band of interest and, secondly, an accurately maintained constant spacing between the coupling units such that a 90° phase delay is caused to the propagating modes between any two successive units at an appropriately chosen frequency. On the other hand, the downlink signals enter the principal waveguide (10) through the common port (14) and encounter, due to the corrugations of the principal waveguide, an inductive reactance boundary such that the EH11 hybrid mode is supported with tendency for concentration of energy near the reactance boundary wall and with a propagation constant shifted towards higher values. The secondary waveguides (11), whereas, have the phase dispersion characteristics in the downlink such that either no propagation of signals in the entire band or propagation of signals in a part or complete band with low phase propagation constant is allowed. As a result of the thus created widely separated propagation constants associated with the modes of principal and secondary waveguides at the downlink, there is a negligible transfer of energy taking place from the principal into the secondary waveguides. In fact, a total rejection of the downlink signals going into the secondary waveguides would happen when the secondary waveguides do not allow unattenuated propagation of signals at this band. Hence, the downlink signals essentially propagate across the principal waveguide (10) unaltered and are delivered at the downlink port (Rx).

It can be easily seen that the above discussed OMTD is a reciprocal component in respect of the direction of propagation of the uplink and downlink signals. Thus the OMTD performs equally well irrespective of whether the ports (Tx,Rx and 14) are handling outgoing or incoming signals at their assigned bands. In each case, the signals are processed in accordance with the principles of the present invention to yield: outgoing signals at the common port (14) whenever a uplink signal is launched at the secondary waveguide port (Tx) or a downlink signal is launched at the downlink port (Rx), or in a reciprocal situation, only the downlink signals appearing at the downlink port (Rx) and only the uplink signals appearing at the secondary waveguide ports (Tx) whenever such signals are launched at the common port (14).

For applications in earth stations of communications via satellite, the above discussed OMTD presents a great advantage in terms of the processing of the downlink signal with a very low insertion loss achieved by virtue of the straight forward path followed by the signals and the high coupling rejection of the signals furnished by the multihole coupler arrangement. This low insertion loss characteristic at the receive band is a very important requirement for the earth stations in order to be able to recover the desired feeble signals arriving from the satellite against a background of noise, the level of which is directly dependent on the losses in the components.

Since the field configurations of the propagating modes in the principal waveguide (10) are represented by HE11 mode (with more concentration of energy near the axis of the waveguide) in the uplink and EH11 mode (with more concentration of energy near the reactance boundary wall) in the downlink, it is important that a suitable matching section (25) is connected between the common part (14) and the throat of the corrugated horn (not shown in figures) to allow these modes with distinct field distributions to be both delivered simultaneously into the throat of the horn as HE11 mode (the desired launching mode for a corrugated horn) without causing conversion into unwanted higher order modes or introducing a higher level of return loss. A special corrugated matching section (25) with dual-depth corrugations (26), developed recently, based on a novel design concept which is the subject of copending U.S. patent application Ser. No. 776,167 filed Sept. 5, 1985, now U.S. Pat. No. 4,680,558, is utilized for this purpose which allows practically an independent control of the boundary reactance in the two bands of concern through a gradual change in the depth of predominantly one of the dual-depth slots in the corrugation configuration so that while for the uplink a high reactance capacitive boundary condition is maintained all along the length of the matching section to support unaltered propagation of the HE11 hybrid mode, on the other hand, for the downlink a continuous change in boundary condition is simulated initially from the inductive reactance to a very low reactance (analogous to continuous waveguide boundary condition) and then into a capacitive reactance rising to a high value, thus enabling a transformation of the EH11 hybrid mode present at the common port (14) intermediately into a TE11 like mode which finally converts into the desired HE11 mode as the throat of the horn is approached.

The multihole directional coupling arrangement as employed in the present OMTD, in accordance with the well established procedures for optimising the performance of a directional coupler, employs a variation in the strength of the coupling along the length of the coupler based on certain special distributions to achieve a highly directional broadband coupling behaviour in the uplink. As a result of the highly directive coupling characteristics of the device in the uplink, the leakage of uplink signals into the downlink port (Rx) is kept at a very low level. Moreover, the matched terminations (15) are placed in the secondary waveguides to ascertain that the uncoupled residual uplink signals are absorbed and hence these signals do not retrace their path in the secondary waveguide propagating in the wrong direction towards the downlink port (Rx). Lastly, the multihole coupling configuration allows the OMTD to have a capacity to handle a high level of microwave power in the uplink since the intensity of the fields present across the apertures of a coupling unit (12), which arises due to a fraction of the total energy transferred at a time, is sufficiently low to prevent any voltage breakdown.

Although, the above described OMTD has been, mainly, discussed in the context of its use in satellite communication with extended bands of operation given by (3.4–4.8 GHz) for the downlink and (5.8–7.075 GHz) for the uplink, it must be, however, appreciated that the OMTD is not restricted in its operation for these bands only. In fact, whenever signals in two bands of frequency have to be separated while preserving their polarization characteristics, an OMTD can be configured based on the above described characteristics of the device and in accordance with the principles of the present invention.

Figure 3:
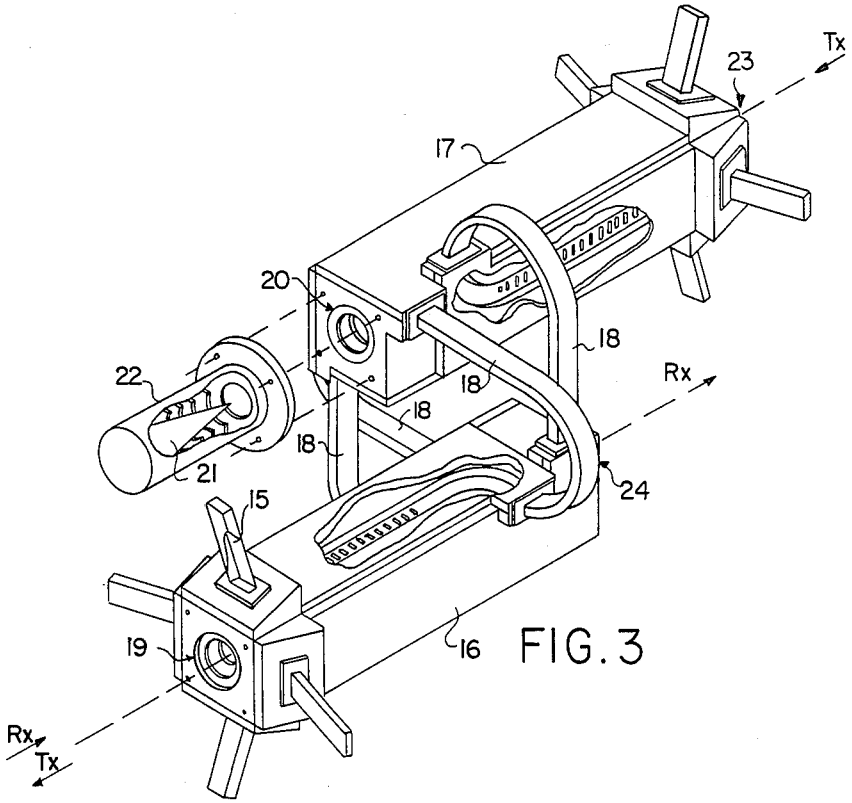
FIG. 3 illustrates a perspective view, partly in cutaway, of the configuration of a diplexing system for satellite communication earth stations which has two OMTDs connected in a back to back arrangement through a network of waveguides.

In a frequency reuse diplexing system for satellite communication earth stations, as illustrated in FIG. 3, two OMTDs (16 and 17) may be connected in a back to back arrangement through a network of waveguides. Referring to FIG. 3, the secondary waveguides of the first and second OMTDs (16 and 17) are interconnected through identical waveguide segments (18), all of them having an equal electrical length. The common port (19) of the first OMTD (16) is supposedly connected to a corrugated matching section (not shown in FIG. 3) leading into the throat of the corrugated horn (also not shown). The downlink port (20) of the second OMTD is terminated in a load (21) contained in a corrugated waveguide (22). The uplink signals enter the common port (23) of the second OMTD, which are then directionally coupled into the secondary waveguides of the second OMTD, whereafter the signals are transferred through the waveguide segments (18) into the secondary waveguides of the first OMTD in order to be finally coupled into the principal waveguide of the first OMTD with a directional propagation towards the common port (19). The downlink signals, whereas, find their way into the first OMTD (16) through the common port (19) after having traversed the corrugated horn and the matching section (not shown). These signals follow a direct path through the principal waveguide of the first OMTD (16) towards the downlink port (24) without undergoing any changes in their characteristics.

The construction of a diplexing system in this manner having two OMTDs in a back to back connection through waveguide networks, permits frequency reuse operation with any arbitrary dual orthogonally polarized signals in the transmit and the receive bands since the diplexer in this arrangement is able to preserve the polarization characteristics of the signals irrespective of whatever is the nature of polarization.

Figure 4:
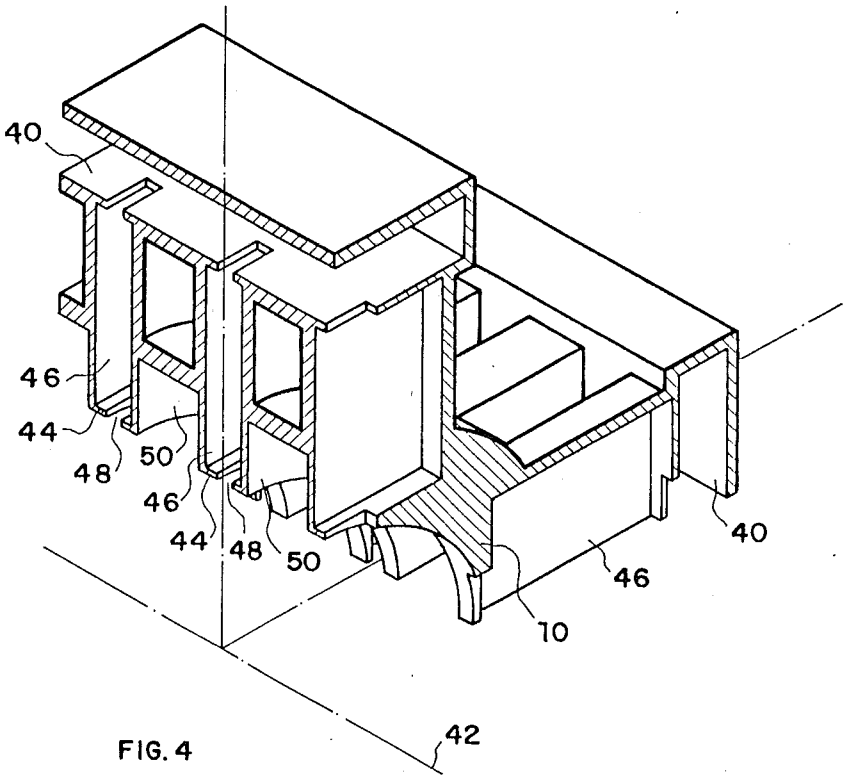
FIG. 4 illustrates a perspective view, partly in cutaway, of a branching coupler arrangement according to the principles of the subject invention.

Now considering the variations in the construction of the OMTD, one equally possible alternative realization of the component, keeping in accordance with the principles of the present invention would be to have a branching coupler arrangement as shown in FIG. 4 where the secondary waveguides (40) would be shifted radially outwards from the axis (42) of the principal waveguide, such that these waveguides no more could share a common wall (44) with the principle waveguide (10), and then, in order to allow coupling of energy between the principal and secondary waveguides, a series of equally spaced, radially running (with respect to the axis of principal waveguide), identical, reduced height, rectangular branch waveguides (46) would be deployed with their broad wall dimension not exceeding that of the secondary waveguides besides being transversely aligned to the axis of the principal waveguide (10). These radially running branch waveguides, being four per transverse plane displayed symmetrically about the axis of the principal waveguide (10), would create an aperture-like opening (48) into the principal waveguide each time through a centrally located position on the width of the irises (50) that are present in the principal waveguide creating the corrugation boundary. Obviously, the irises (50) would, for this instance, have a width which would exceed the narrow wall dimension of the branch waveguides that would interconnect the principal and the secondary waveguides.

Figure 5:
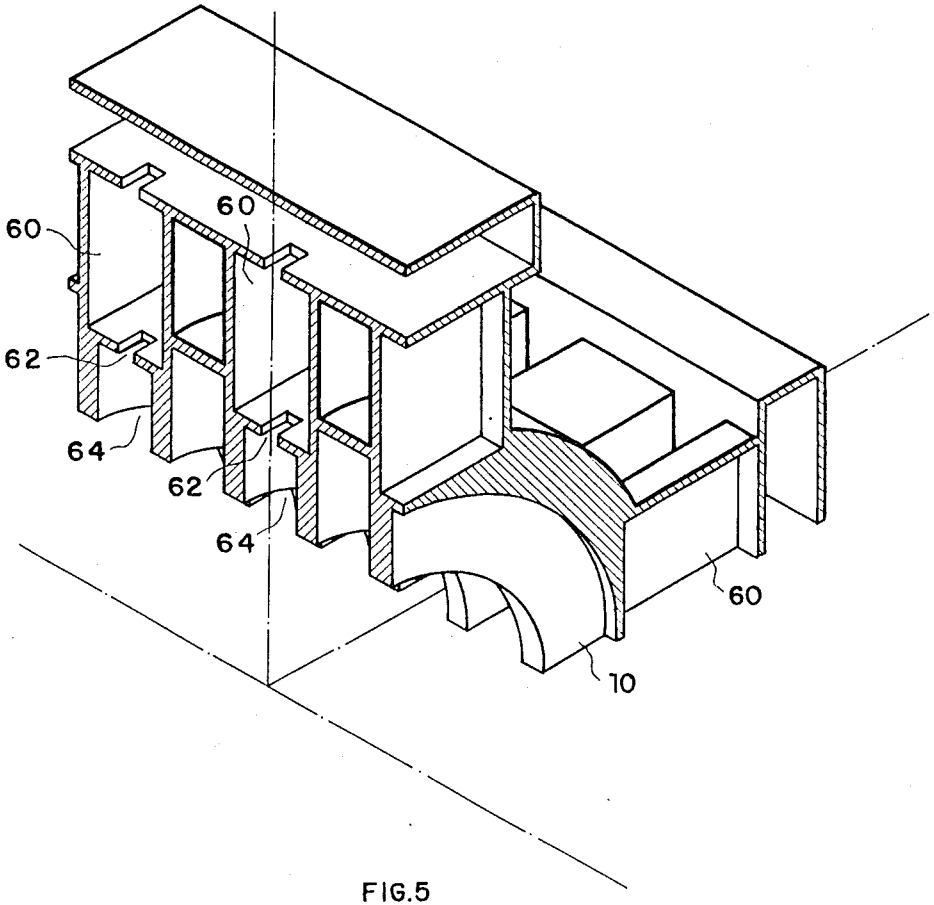
FIG. 5 illustrates a perspective view, partly in cutaway, of an alternative branching coupler arrangement according to the principles of the subject invention.

Another model of the OMTD to implement, would be, once again, as illustrated in FIG. 5 a branching coupler arrangement just described, however, in this case the interconnecting branch waveguides (60) between the principal and the secondary waveguides would include an aperture-like opening (62) into the principal waveguide (10), each time, at such locations that the openings would now be centrally located across the width of a corrugation slot (64). For this model, it would be necessary to assume that the width of the corrugation slots (64) in the principal waveguide is greater than the narrow wall dimension of the interconnecting branch waveguides (60).

Figure 6:
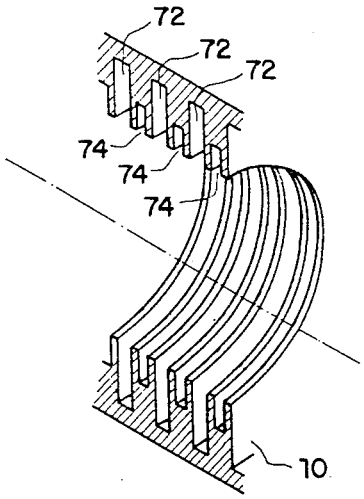
FIG. 6 illustrates a variation of an OMTD design according to the principles of the subject invention.

Yet another useful variation of the OMTD design (applicable to any of the previously considered models), once again, in accordance with principles of the present invention, would be to simply reconfigure the corrugations present in the principal waveguide (10) with dual-depth corrugations as shown in FIG. 6 which are formed by interspreading slots (72) of one common depth with slots (74) of another common depth so that in the resulting corrugated configuration the successive slots are of a different depth while the alternate slots are of a common depth. Situations may arise where the two bands to be diplexed are so located that the desired reactance boundary condition, which would support the wanted modes in the principal waveguide, cannot be simultaneously simulated in both bands by employing the conventional corrugations. Under such circumstances, the above mentioned reconfiguration of the corrugations might be necessary.

Referring to the constant spacing between each successive transverse plane where the coupling apertures are located vis-e,gra/a/ -vis in the principal and the secondary waveguides, in all the models discussed so far, this separation is accurately maintained to give a 90° phase delay for the propagating modes of the principal as well as secondary waveguides (supposedly both modes have identical phase change constant) at an appropriately chosen frequency in the uplink.

Although the invention has been described above with references to some likely variations in its construction that may be effected, it must be, however, recognized that there are various other additions and modifications possible which, nevertheless, continue to be in accordance with the principles of the present invention. For example, the principle waveguide (10) of the OMTD mentioned above may be changed from the waveguide of circular cross-section into a square or any other suitable cross-section without introducing any essential change in the philosophy of functioning. It could similarly be a possible variation in the construction of the OMTD to simulate the reactance boundary wall in the principal waveguide (10) by replacing the corrugations (13) by a suitable dielectric coating. Following in this manner, such alternative means of modelling the OMTD are, in a way, unlimited.

We claim:

1. A directional coupler comprising:

a. a principle waveguide, having a longitudinal axis and an interior surface surrounding said axis, said principle waveguide comprising means for simultaneously:

i. supporting, with a first propagation constant and without depolarization, effective propagation of first signals in a first frequency band at a low order of a first mode having a greater concentration of energy near said axis of said principle waveguide than near said interior surface, while not supporting propagation of signals in said first frequency band at unwanted modes, and ii. supporting, with a second propagation constant and without depolarization, effective propagation of second signals in a second, lower frequency band at a low order of a second different mode having a greater concentration of energy near said interior surface of said principle waveguide than near said axis of said principle waveguide, while not supporting propagation of signals in said second frequency band at unwanted modes;

b. a set of secondary waveguides placed externally and symmetrically at equal circumferential intervals about the outside perimeter of said principle waveguide, with each said secondary waveguide having a longitudinal axis running parallel to said longitudinal axis of said principle waveguide, said secondary waveguides configured to support propagation of said first signals with a third propagation constant which is in close agreement with said first propagation constant, while not supporting effective propagation of said second signals with a propagation constant which is the same as said second propagation constant; and c. a plurality of coupling units disposed at longitudinal intervals along said principle waveguide for permitting an exchange of energy between said secondary waveguides and one end of said principle waveguide, whereby signals in said first frequency band are communicated between said one end of said principle waveguide and said secondary waveguides due to the common propagation constants of said first signals in said principle waveguide and in said secondary waveguides, and signals in said second frequency band are communicated between said one end of said principle waveguide and the other end of said principle waveguide without coupling to said secondary waveguides at least due in part to the difference between the propagation constant of said second signals in said principle waveguide and the propagation constant of said second signals in said secondary waveguides.

2. A coupler of claim 1 comprising four of said secondary waveguides.

3. A directional coupler comprising:

a. a principle waveguide, having a longitudinal axis and an interior surface surrounding said axis to form said principle waveguide, said interior surface comprising a corrugated structure having a plurality of slots of uniform thickness and uniform depth formed by an inner wall and a plurality of finite thickness washer-like flanges extending radially inward from said inner wall toward said axis, said flanges being aligned transverse with respect to said longitudinal axis, successive ones of said slots being spaced one from the other with not more than 90 degrees of phase delay therebetween for first signals in a first frequency band, said corrugated structure comprising means for simultaneously:

i. supporting, with a first propagation constant and without depolarization, effective propagation of said first signals in said first frequency band at a low order of a first mode having a greater concentration of energy near said axis of said principle waveguide than near said interior surface, while not supporting propagation of signals in said first frequency-band at unwanted modes, and ii. supporting, with a second propagation constant and without depolarization, effective propagation of second signals in a second, lower frequency band at a low order of a second, different mode having a greater concentration of energy near said interior surface of said principle waveguide than near said axis of said principle waveguide, while not supporting propagation of signals in said second frequency band at unwanted modes;

b. a set of secondary waveguides placed externally and symmetrically at equal circumferential intervals about the outside perimeter of said principle waveguide, with each said secondary waveguide having a longitudinal axis running parallel to said longitudinal axis of said principle waveguide, said secondary waveguides configured to support propagation of said first signals with a third propagation constant which is in close agreement with said first propagation constant, while not supporting effective propagation of said second signals with a propagation constant which is the same as said second propagation constant; and c. a plurality of coupling units each disposed at longitudinal intervals along said principle waveguide, with each coupling unit comprising N aperture-like structures, said aperture-like structures for each said coupling unit located in a corresponding plane transverse to said longitudinal axis of said principle waveguide, and with each of said N aperture-like structures interconnecting a respective one of said secondary waveguides and said principle waveguide for exchanging energy between said secondary waveguides and one end of said principle waveguide, whereby signals in said first frequency band are communicated between said one end of said principle waveguide and said secondary waveguides due to the common propagation constants of said first signals in said principle waveguide and in said secondary waveguides, and signals in said second frequency band are communicated between said one end of said principle waveguide and the other end of said principle waveguide without coupling to said secondary waveguides at least due in part to the difference between the propagation constant of said second signals in said principle waveguide and the propagation constant of said second signals in said secondary waveguides.

4. A coupler of claim 3 wherein said transverse planes in which said aperture-like structures are located are each located at the center of thickness of a slot in said principle waveguide.

5. A directional coupler comprising:

a. a principle waveguide, having a longitudinal axis and an interior surface surrounding said axis to form said principle waveguide, said interior surface comprising a corrugated structure having an inner wall and having a plurality of alternately positioned first and second slots formed in said wall, said first and second slots being aligned transverse with respect to said longitudinal axis, each said first slots having a first transverse depth, each said second slots having a separate, different transverse depth and said first and second slots having the same longitudinal thickness, said first slots being spaced one from the other with not more than 90 degrees of phase delay therebetween for first signals in a first frequency band, said corrugated structure comprising means for simultaneously:

i. supporting, with a first propagation constant and without depolarization, effective propagation of said first signals in said first frequency band at a low order of a first mode having a greater concentration of energy near said axis of said principle waveguide than near said interior surface, while not supporting propagation of signals in said first frequency band at unwanted modes, and ii. supporting, with a second propagation constant and without depolarization, effective propagation of second signals in a second, lower frequency band at a low order of a second, different mode having a greater concentration of energy near said interior surface of said principle waveguide than near said axis of said principle waveguide, while not supporting propagation of signals in said second frequency band at unwanted modes;

b. a set of secondary waveguides placed externally and symmetrically at equal circumferential intervals about the outside perimeter of said principle waveguide, with each said secondary waveguide having a longitudinal axis running parallel to said longitudinal axis of said principle waveguide, said secondary waveguides configured to support propagation of said first signals with a third propagation constant which is in close agreement with said first propagation constant, while not supporting effective propagation of said second signals with a propagation constant which is the same as said second propagation constant; and c. a plurality of coupling units disposed at longitudinal intervals along said principle waveguide, with each coupling unit comprising N aperture-like structures, said aperture-like structures for each said coupling unit located in a corresponding plane transverse to said longitudinal axis of said principle waveguide, and with each of said N aperture-like structures interconnecting a respective one of said secondary waveguides and said principle waveguide for exchanging energy between said secondary waveguides and one end of said principle waveguide, whereby signals in said first frequency band are communicated between said one end of said principle waveguide and said secondary waveguides due to the common propagation constants of said first signals in said principle waveguide and in said secondary waveguides, and signals in said second frequency band are communicated between said one end of said principle waveguide and the other end of said principle waveguide without coupling to said secondary waveguides at least due in part to the difference between the propagation constant of said second signals in said principle waveguide and the propagation constant of said second signals in said secondary waveguides.

6. A coupler of claim 1, 3 or 5 wherein said low order of said first mode is the HE11 hybrid mode and said low order of said second mode is the EH11 hybrid mode.

7. A coupler of claim 1, 3 or 5 wherein said interior surface of said principle waveguide is circular in cross-section.

8. A coupler of claim 1, 3 or 5 wherein said interior surface is circular in cross-section and wherein said secondary waveguides are rectangular in cross-section, having broad walls thereof aligned parallel to a surface which is tangential to said interior surface of said principle waveguide, and wherein a plurality of said coupling units are distributed uniformly along the longitudinal length of each secondary waveguide on those broad walls of said secondary waveguides which are closest to said principle waveguide.

9. A coupler of claim 1, 3 or 5 wherein said secondary waveguides are placed at a certain radial distance away from said interior surface of said principle waveguide, and wherein to achieve exchange of energy between said principle and secondary waveguides a plurality of identical rectangular branching waveguides are provided having a broad wall dimension aligned transverse to the longitudinal axis of said principle waveguide, said branching waveguides placed in a radial fashion about said longitudinal axis of said principle waveguide to establish branching waveguide connection between said principle and secondary waveguides at each location of said coupling units.

10. A coupler of claim 3 or 5 wherein said transverse planes in which said aperture-like structures are located are each located at the center of thickness of a slot in said principle waveguide.

11. A coupler of claim 3 or 5 wherein the spacing between successive ones of said transverse planes wherein said aperture-like structures are located is such that said 90 degree phase shift is maintained over said spacing for said first signals in both said principle and secondary waveguides.

12. A coupler of claim 3 or 5 comprising four of said secondary waveguides and wherein N equals four.

13. A coupler of claim 12 wherein said four secondary waveguides are placed in contact with a perimeter outer surface of said principle waveguide such that there are regions which form a thin common wall for said principle waveguide and said secondary waveguides.

14. A coupler of claim 13 wherein said coupling units are placed on said common walls transversely with respect to the longitudinal axis of said principle waveguide and are dimensioned to measure in the transverse direction no more than the thickness of said common wall and in the axial direction no more than the thickness of said first and second slots.

15. A coupler of claim 13 wherein said transverse planes, in which said aperture-like structures are located, are each centrally located along the longitudinal dimension of a corresponding slot in said principle waveguide.

* * * * *